US006408756B1

(12) United States Patent
D'Annunzio et al.

(10) Patent No.: US 6,408,756 B1
(45) Date of Patent: Jun. 25, 2002

(54) PRINTING UNIT WITH PRINTING CYLINDER HAVING SIMPLIFIED REMOVAL AND LOCKING

(75) Inventors: Federico D'Annunzio, Cislago; Giacomo Maccalli, Lodi, both of (IT)

(73) Assignee: Gi Due S.r.l., Cislago (IT)

( * ) Notice: Subject to any disclaimer, the term of this patent is extended or adjusted under 35 U.S.C. 154(b) by 14 days.

(21) Appl. No.: 09/670,989

(22) Filed: Sep. 26, 2000

(30) Foreign Application Priority Data

Oct. 11, 1999 (EP) ..... 99830639

(51) Int. Cl.[7] ..... B41F 13/44
(52) U.S. Cl. ..... 101/479; 101/216
(58) Field of Search ..... 101/212, 216, 101/219, 368, 375, 376, 479, 480, 152, 174, DIG. 35; 400/641, 660

(56) References Cited

U.S. PATENT DOCUMENTS 4,572,069 A * 2/1986 Schwarzbeck ..... 101/216
5,669,302 A * 9/1997 Rogge et al. ..... 101/216
6,247,406 B1 * 6/2001 D'Annunzio et al. ..... 101/479

FOREIGN PATENT DOCUMENTS

| | | |
|---|---|---|
| EP | A-0 196 501 | 10/1986 |
| EP | A- 0 234 456 | 9/1987 |
| EP | A-0 741 010 | 6/1996 |
| EP | A-0 911 158 | 4/1999 |

* cited by examiner

*Primary Examiner*—Leslie J. Evanisko
(74) *Attorney, Agent, or Firm*—Guido Modiano; Albert Josif; Daniel O'Byrne

(57) ABSTRACT

A printing unit with removable printing cylinder, comprising two outer shoulders which are adapted to constitute a supporting frame for a printing cylinder, a first pair of arms and a second pair of arms which are pivoted at an upper end of each one of the shoulders and form a seat for accommodating the printing cylinder, elements for locking the printing cylinder being provided in order to retain the printing cylinder so that it rests on the first and second pairs of arms.

9 Claims, 3 Drawing Sheets

PRINTING UNIT WITH PRINTING CYLINDER HAVING SIMPLIFIED REMOVAL AND LOCKING

BACKGROUND OF THE INVENTION

The present invention relates to a printing unit with a printing cylinder having simplified removal and locking. More particularly, the invention relates to a flexographic printing unit with a printing cylinder which can be easily removed from its seat and can be locked simply.

It is known that printing units, for example for flexographic printing, are provided with a plurality of printing cylinders: a first cylinder is an inking cylinder which dips into an ink tray in order to draw ink for printing; a second cylinder is a cylinder on which the print to be transferred to paper or another medium is provided; and a third cylinder is the actual printing cylinder, against which the cylinder that bears the type abuts in order to perform printing on the paper that winds around the printing cylinder.

Finally, a fourth cylinder arranged downstream of the printing cylinder allows to transport the printed paper from one printing unit to a subsequent printing unit or to the outlet at the end of the printing cycle.

The printing cylinder requires frequent operations for replacing it, in order to pass from one diameter to another, depending of the type of printing to be performed.

Replacing the printing cylinder usually takes time, since it is necessary to release the cylinder from its seat and then remove it. These operations are difficult owing to the configuration of the printing unit, and this difficulty, when it is necessary to replace several printing cylinders, entails long replacement times, for example in the case of a plurality of printing units arranged in series.

Moreover, the printing cylinder must be adjusted in its position with respect to the cylinder bearing the type, which accordingly abuts against the printing cylinder.

SUMMARY OF THE INVENTION

The aim of the present invention is to provide a printing unit with a printing cylinder which can be easily removed and just as easily locked in its seat.

Within the scope of this aim, an object of the present invention is to provide a printing unit with a printing cylinder which can be released, and then removed, with a single simple operation without having to disassemble fixed parts of the printing unit.

Another object of the present invention is to provide a printing unit with a printing cylinder whose position can be adjusted with respect to the cylinder that bears the type and with respect to an impression cylinder.

Another object of the present invention is to provide a printing unit with a printing cylinder which can be adjusted vertically and horizontally with respect to the cylinder that bears the type.

Another object of the present invention is to provide a printing unit having a printing cylinder which can be removed easily, is highly reliable, relatively easy to manufacture and at competitive costs.

This aim, these objects and others which will become apparent hereinafter are achieved by a printing unit with removable printing cylinder, characterized in that it comprises two outer shoulders which are adapted to constitute a supporting frame for a printing cylinder, a first pair of arms and a second pair of arms which are pivoted at an upper end of each one of said shoulders and form a seat for accommodating said printing cylinder, means for locking said printing cylinder being provided in order to retain said printing cylinder so that it rests on said first and second pairs of arms. dr

BRIEF DESCRIPTION OF THE DRAWINGS

Further characteristics and advantages of the invention will become apparent from the description of a preferred embodiment thereof, illustrated only by way of non-limitative example in the accompanying drawings, wherein.

DESCRIPTION OF THE PREFERRED EMBODIMENTS

Figure 6:
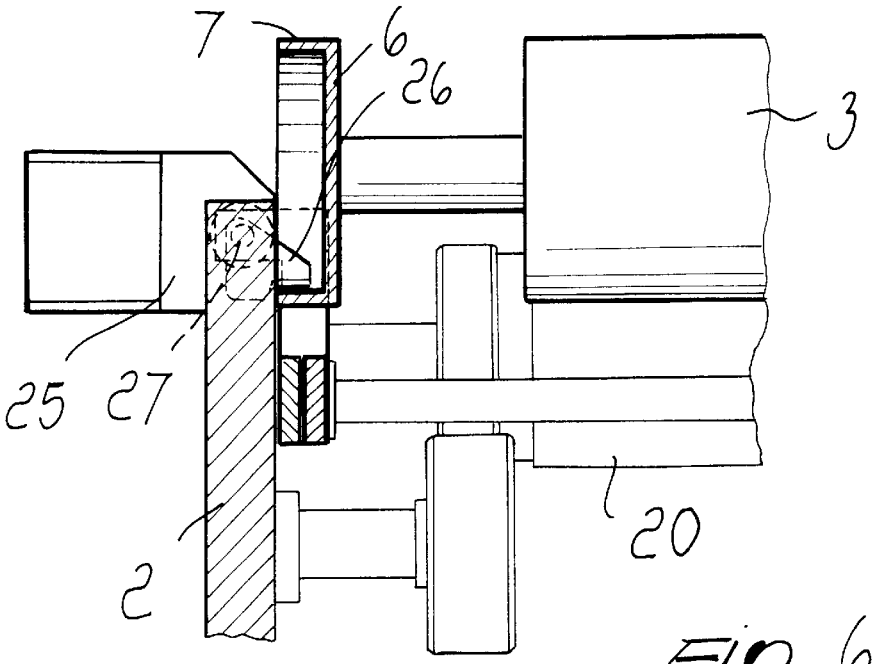
FIG. 6 is a partially sectional front elevation view of the arrangement of the printing cylinder in the appropriately provided seat and of its corresponding locking.

With reference to the above figures, the printing unit according to the present invention, of which the portion related to the printing cylinder is shown and generally designated by the reference numeral 1, comprises two lateral outer uprights 2, only one of which is shown, which form a supporting frame for a printing cylinder 3 which is accommodated in an appropriate seat formed on the top of said outer lateral shoulders 2.

Figure 1:
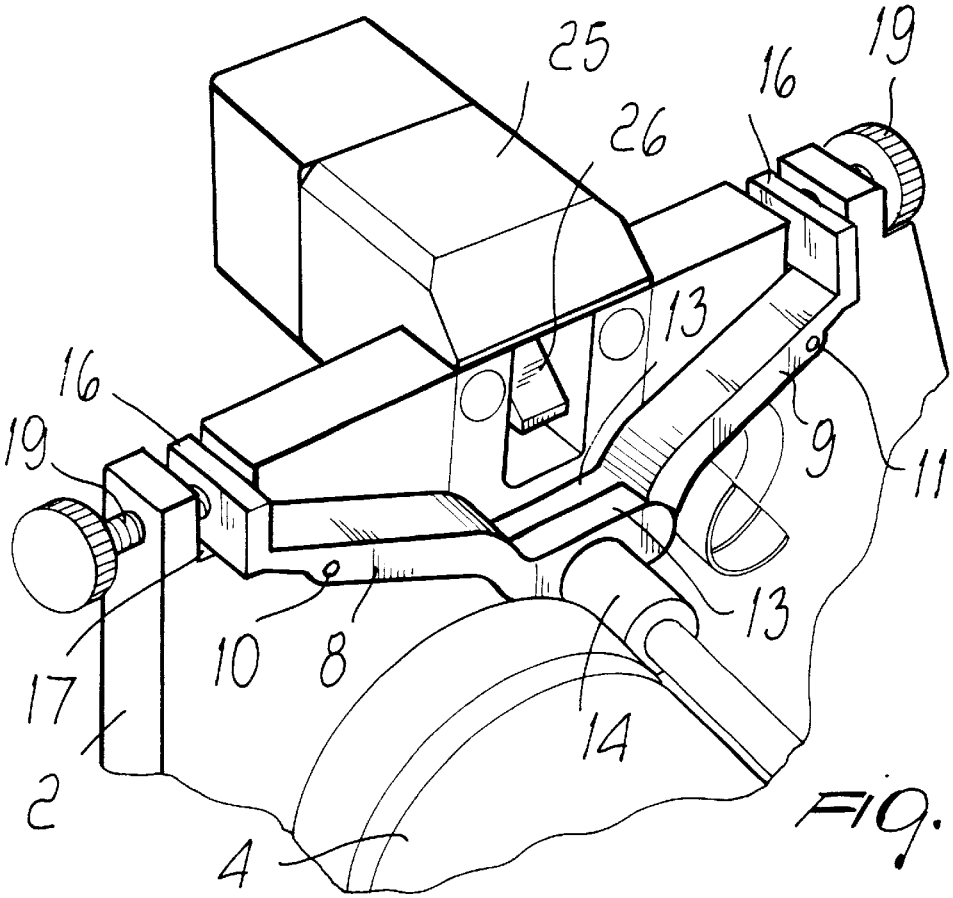
FIG. 1 is a partial perspective view of the means for adjusting and locking the printing cylinder, with the printing cylinder removed.

FIG. 1 partially shows a cylinder of the printing unit, designated by the reference numeral 4, which represents the cylinder that bears the type and is meant to abut against the printing cylinder 3, which is omitted in FIG. 1 for the sake of simplicity in illustration, so as to transfer the type to the paper that passes over the printing cylinder 3.

The printing cylinder 3 is conveniently provided with means for adjusting its position both in a vertical direction, i.e., at right angles to the footing of the printing unit, and in a horizontal direction, i.e., transversely along the length of the printing unit.

Adjustment of the position of the printing cylinder 3 is important in order to adjust its relative position with respect to the cylinder 4 bearing the type and to the cylinder 20, for example when it is necessary to replace the printing cylinder 3 with a cylinder having a different diameter.

In this case, simple adjustment is essential in order to be able to place the printing cylinder 3 in the correct position with respect to the cylinder 4 and the cylinder 20.

The cylinder 3 further has extremely simplified locking means which allow, once the printing cylinder 3 has been arranged in its seat, to lock it very rapidly and with a single operation without modifying the above-cited adjustments.

The locking means further allow equally simplified removal of the printing cylinder 3.

Figure 5:
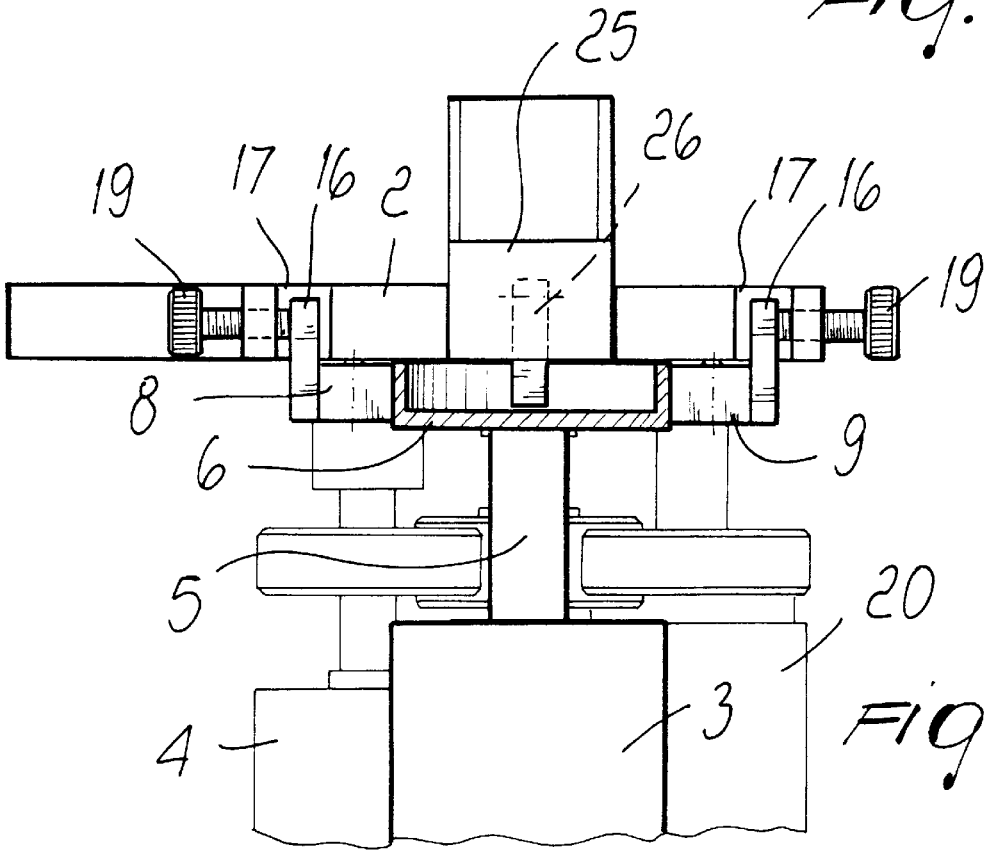
FIG. 5 is a plan view, similar to FIG. 4 but with the printing cylinder arranged in the appropriately provided seat.

In detail, as shown by FIGS. 5 and 6, the printing cylinder 3 has, at its ends, a shaft portion 5 which is arranged along its axis and supports a circular element 6 with raised edges 7 which form an engagement surface for means for locking the printing cylinder 3 in its seat.

Figure 2:
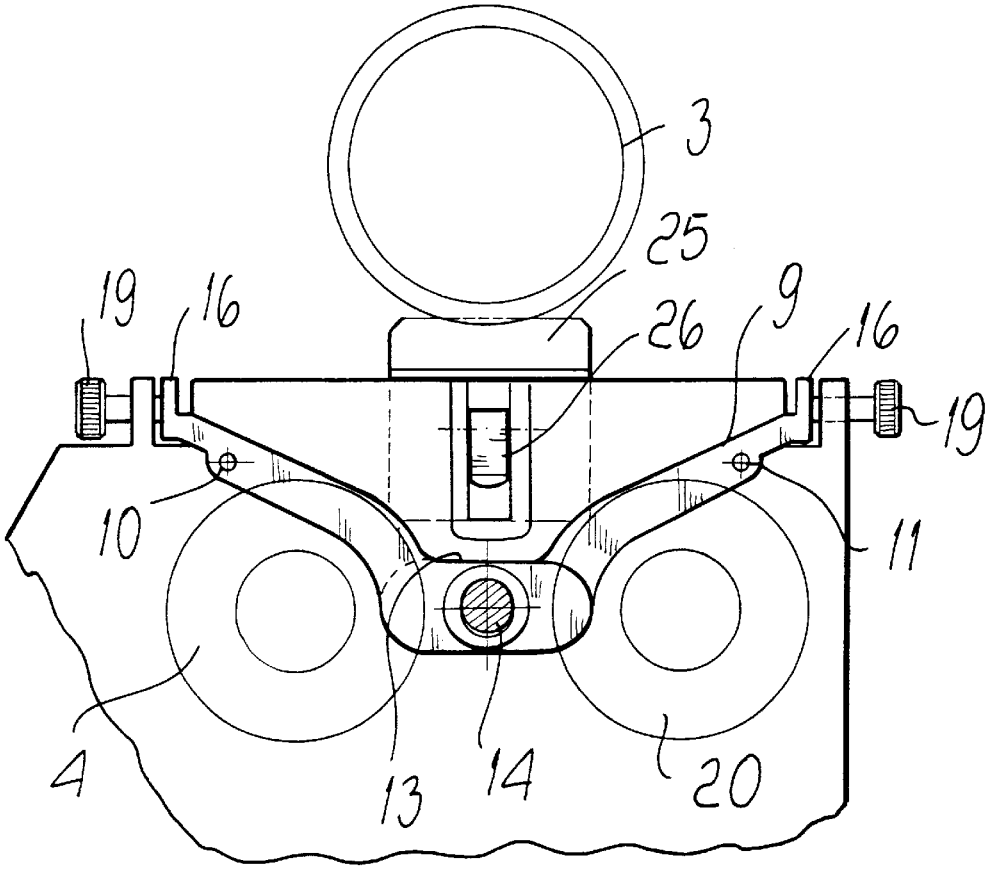
FIG. 2 is a partial side view, with the printing cylinder shown in the removed position.
Figure 3:
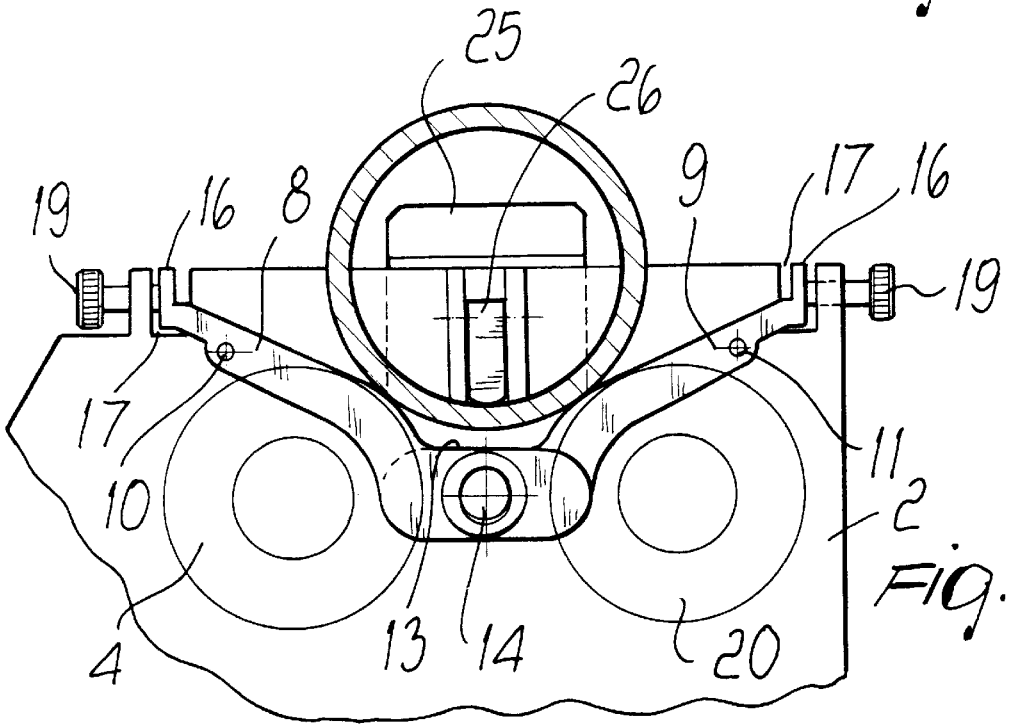
FIG. 3 is a partial side view of the printing cylinder accommodated in its seat and locked thereat.

As shown in detail in FIGS. 1, 2 and 3, the seat of the printing cylinder 3 is formed by two shaped arms 8 and 9 which are respectively pivoted to the shoulder 2 at points 10 and 11. There are of course two arms 8 and 9 for each side of the printing cylinder and likewise there are two pivots 10 and 11 for each pair of arms 8 and 9.

The two arms 8 and 9 have a curved shape so that when the arms 8 and 9 are mutually coupled at a flat end region 13 thereof, regardless of the diameter of the printing cylinder the relative position of said printing cylinder with respect to the cylinder 4 and to the cylinder 20 does not change as the diameter of the printing cylinder varies.

The coupling between the two arms 8 and 9 is provided by means of an eccentric element 14, and each arm 8 and 9 ends, at the tip that lies furthest from the coupling to the eccentric element, with the plate-like element 16, which is accommodated in a slot 17 formed in the shoulder 2.

Each plate-like element 16 constitutes an abutment element for an adjustment screw 19 which allows to adjust the position of the arm 8 and 9 within the slot 17 of the shoulder, so as to transversely vary the relative position of the printing cylinder 3 with respect to the cylinder 4 that bears the type and with respect to a cylinder 20 which lies downstream of the printing cylinder 3 and below it, as shown in FIGS. 2, 3, 4, 5 and 6.

Figure 4:
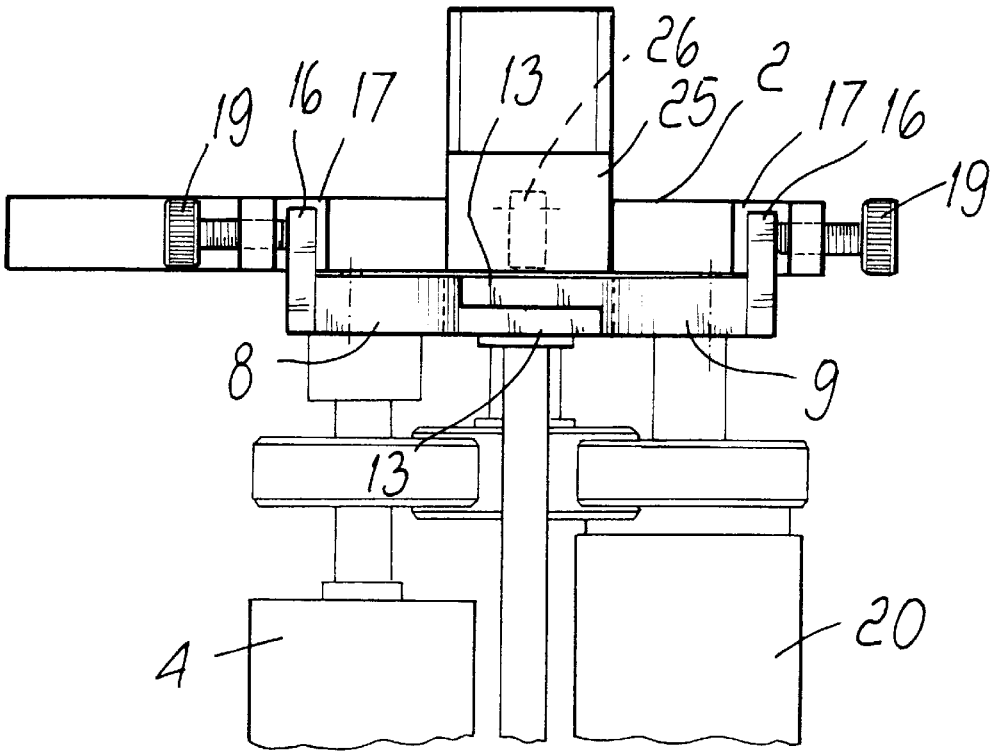
FIG. 4 is a top plan view of the seat for accommodating the printing cylinder and the corresponding locking means.

Conveniently, as shown in FIG. 4, the coupling between the two arms 8 and 9 is provided by way of the fact that the two arms 8 and 9 have an end, formed by the flat region 13, which is complementarily step-shaped, so that the two arms, once coupled, are arranged so that their sides are parallel and have no discontinuities.

The adjustment screw 19 abuts against the plate-like element 16 of each arm and pushes against the respective arm, which rotates about the rotation point 10, 11 and about the eccentric element 14, so as to vary the vertical position of the printing cylinder 3 with respect to the cylinder 4 and the cylinder 20.

This vertical adjustment is necessary, for example, when replacing the printing cylinder 3 with a cylinder having a different diameter, and since it is necessary to maintain a constant distance between said printing cylinder 3 and the cylinders 4 and 20 that must abut against the printing cylinder 3 it is necessary to be able to adjust very easily the position of the printing cylinder 3 with respect to the cylinder 4 and the cylinder 20.

The means for locking the printing cylinder 3, which are conveniently designated by the reference numeral 25, comprise for example pneumatic locking means which are provided with engagement means 26 suitable to engage the edges 7 of the disk-like element 6 which is rigidly coupled to the printing cylinder 3.

Substantially, the engagement means 26 can be conveniently constituted, for example, by a tooth which is pivoted about a pivot 27 and by being actuated pneumatically, for example, abuts against the edge 7 of the disk-like element 6, thus keeping the printing cylinder 3 firmly retained in its seat, i.e., rested on the flat portions 13 of the two arms 8 and 9.

As shown in FIG. 3, the printing cylinder 3 is accommodated on the pair of arms 8 and 9 and is kept raised from the flat portion 13 of the coupled ends of the arms 8 and 9.

FIG. 3 is a view of the printing cylinder 3 in the position for locking by means of the tooth 26, which engages the raised edge 7 of the disk-like element 6.

In practice it has been observed that the printing unit with removable printing cylinder according to the invention fully achieves the intended aim and objects, since it allows, because of the presence of means for adjusting and locking the printing cylinder, to access the printing cylinder in a simplified manner, in order to be able to remove it and then reposition it, with a very simple operation, without requiring modifications to the adjustment of the relative position thereof with respect to the remaining cylinders, regardless of the diameter of the printing cylinder.

The printing unit thus conceived is susceptible of numerous modifications and variations, all of which are within the scope of the inventive concept; all the details may also be replaced with other technically equivalent elements.

In practice, the materials employed, so long as they are compatible with the specific use, as well as the dimensions, may be any according to requirements and to the state of the art.

The disclosures in European Patent Application No. 99830639.3 from which this application claims priority are incorporated herein by reference.

What is claimed is:

1. A printing unit with a removable printing cylinder, comprising two outer shoulders which are adapted to constitute a supporting frame for the printing cylinder, a first pair of arms and a second pair of arms which are pivoted around a pivoting point at an upper end of each one of said shoulders and form a seat for accommodating said printing cylinder, means for locking said printing cylinder being provided in order to retain said printing cylinder so that said printing cylinder rests on said first and second pairs of arms.

2. The printing unit according to claim 1, wherein each one of said pairs of arms comprises a first arm and a second arm which are respectively pivoted to each shoulder, said first and second arms being mutually coupled at an end of said arms which lies opposite the pivoting point, said coupling being provided by means of an eccentric element.

3. The printing it according to one claim 2, wherein each one of said arms is provided with position adjustment means which allow each arm to rotate about the pivoting point and about said eccentric element.

4. The printing unit according to claim 3, wherein said position adjustment means comprise an adjustment screw for each arm.

5. The printing unit according to claim 4, wherein each shoulder having a slot formed therein and each one of said arms having, at the opposite end with respect to the point for coupling to the other arm, a plate element which is accommodated in said slot formed in each shoulder, said plate element being moved within said slot by the pushing action applied by said adjustment screw.

6. The printing unit according to claim 1, wherein said printing cylinder rests on each one of said arms.

7. The printing unit according to claim 1, wherein said means for locking said printing cylinder on said first and second pairs of arms comprise engagement means which are adapted to pass from an inactive position to a position for engaging said printing cylinder.

8. The printing unit according to claim 7, wherein said printing cylinder has, at each end, a shaft portion having a disk element with a raised edge supported thereon, said engagement means being adapted to engage, in the position for engaging said printing cylinder, said raised edge of the disk element.

9. The printing unit according to claim 8, wherein said engagement means comprise a tooth which is suitable to rotate from a disengagement position to an engagement position in which said tooth retains said raised edge of said disk element, keeping said printing cylinder in position on said first and second pairs of arms.

* * * * *